US005829753A

United States Patent [19]

Wiser

[11] Patent Number: 5,829,753

[45] Date of Patent: Nov. 3, 1998

[54] MULTIFUNCTIONAL PORTABLE TARGET STAND AND DISPENSER

[76] Inventor: David E. Wiser, RR #1, Box 98M, Shirleysburg, Pa. 17260

[21] Appl. No.: 898,800

[22] Filed: Jul. 23, 1997

[51] Int. Cl.[6] ..... F41J 1/10

[52] U.S. Cl. ..... 273/407

[58] Field of Search ..... 473/407, 408, 473/403, 404

[56] References Cited

U.S. PATENT DOCUMENTS

| | | | |
|---|---|---|---|
| 3,087,701 | 4/1963 | Wallace | 273/407 X |
| 3,415,519 | 12/1968 | Hand | 273/407 |
| 4,029,318 | 6/1977 | Boss | 273/407 X |
| 4,884,658 | 12/1989 | Banfield | 273/407 X |
| 5,169,157 | 12/1992 | Salmon | 273/407 |
| 5,280,920 | 1/1994 | Knapper | 273/407 |

*Primary Examiner*—William H. Grieb
*Attorney, Agent, or Firm*—Michael I. Kroll

[57] ABSTRACT

A multifunction portable target stand (14) comprising an assembly (16) for holding a target (18). A structure (20) is pivotally connected to the holding assembly (16), for supporting the holding assembly (16) in an upright position above the ground (22) when the supporting structure (20) is in an extended position, so that a person (24) with a shooting weapon (26) at a remote location on the ground (22) can shoot at the target (18). A facility (28) on the supporting structure (20) is for transporting the multifunction portable target stand (14) to another location, when the supporting structure (20) is in a folded up position.

15 Claims, 12 Drawing Sheets

MULTIFUNCTIONAL PORTABLE TARGET STAND AND DISPENSER

BACKGROUND OF THE INVENTION

1. Field of the Invention

The instant invention relates generally to support devices and more specifically it relates to a multifunction portable target stand. The multifunction portable target stand has convenience, total organization and excellent portability built therein, so that a person will be able to carry various targets to an archery or rifle shoot and set it up in a short period of time.

2. Description of the Prior Art

Numerous support devices have been provided in prior art. For example, U.S. Pat. No. 3,415,519 to Hand; 4,029,318 to Boss; 4,884,658 to Banfield; 5,169,157 to Salmon and 5,280,920 to Knapper, II all are illustrative of such prior art. While these units may be suitable for the particular purpose to which they address, they would not be as suitable for the purposes of the present invention as heretofore described.

HAND, GENE WILLIAM

PORTABLE TARGET HOLDER

U.S. Pat. No. 3,415,519

A portable target holder for targets used in rifle and pistol target practice. The holder is supported by at least one freely pivoted leg attached to each side thereof. The supporting arrangement is particularly adapted to support the target vertically on uneven terrain.

BOSS, RICHARD K.

PORTABLE, ADJUSTABLE TARGET STAND

U.S. Pat. No. 4,029,318

A target stand comprises a target holder pivotably mounted on a scissors frame base. The scissors frame base and pivotably mounted target holder are adjustable, collapsible, and portable. The height of the target can be adjusted by extending or retracting the scissors frame base, with a cord or chain running from one side to the other side of the scissors frame base holding the base at its desired position. The target holder is held in position on the scissors frame base by an adjustable position support rod running from the target holder to the scissors frame base. Targets are held in place on the target holder by spring operated plastic clips which are slideably mounted on the target holder. The target stand can be securely attached to the ground by means of removable spikes on the bottom of the base.

BANFIELD, WILLIAM A.

COLLAPSIBLE SAWHORSE

U.S. Pat. No. 4,884,658

A collapsible sawhorse including a crossbeam and two pairs of legs connected at opposite ends of the crossbeam for disposition between a load-supporting position and a folded position. Each pair of legs is pivotally connected to a support member that is pivotally connected to the crossbeam, so that each support member and its pair of legs may collectively pivot between the two positions. Brackets are provided for detachably supporting a projectile target to the crossbeam.

SALMON, MICHAEL E.

TARGET HOLDER

U.S. Pat. No. 5,169,157

An automatic target holder is provided for positioning targets for projectiles at a location remote from a shooter. The target holder includes a housing having a relatively low silhouette and a target support removably mounted upon the housing for positioning a target in a substantially planar firing position normal to a path of a projectile fired by the shooter. A target drive mechanism is located within the housing and is remotely operable by the shooter to advance a target roll to move a new target into the firing position. The target support structure and the housing is oriented outboard of the target in the firing position providing an unobstructed path for the projectile as it passes through the target. The preferred embodiment is provided with a target illumination panel positioned behind the target and shiftable between an inactive position out of the projectile path and an active position behind the target in order to increase the visibility of the projectile holes formed in the target.

KNAPPER, II, WILLIAM J.

PORTABLE TARGET SYSTEM

U.S. Pat. No. 5,280,920

A portable, reusable, disposable, compact package that opens up and reconnects to form an upright target and sight-in system for guns.

SUMMARY OF THE INVENTION

A primary object of the present invention is to provide a multifunction portable target stand that will overcome the shortcomings of the prior art devices.

Another object is to provide a multifunction portable target stand that has convenience, total organization and excellent portability built therein.

An additional object is to provide a multifunction portable target stand wherein as one unit a person will be able to carry various targets to an archery or rifle shoot and then set it up to be ready to be used in a short period of time.

A further object is to provide a multifunction portable target stand that is simple and easy to use.

A still further object is to provide a multifunction portable target stand that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figure 1:
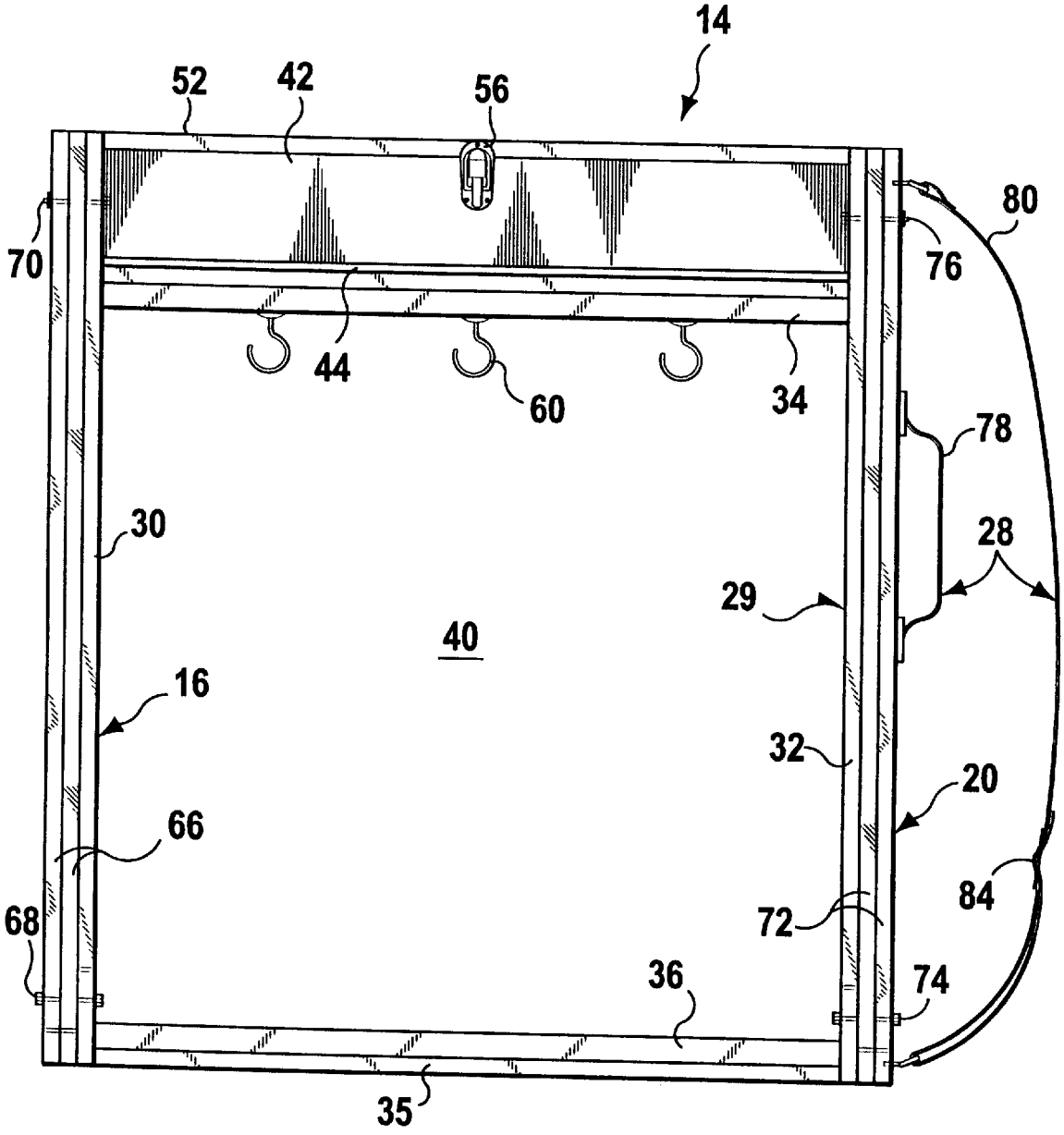
FIG. 1 is a front elevational view of the instant invention in a folded position.
Figure 2:
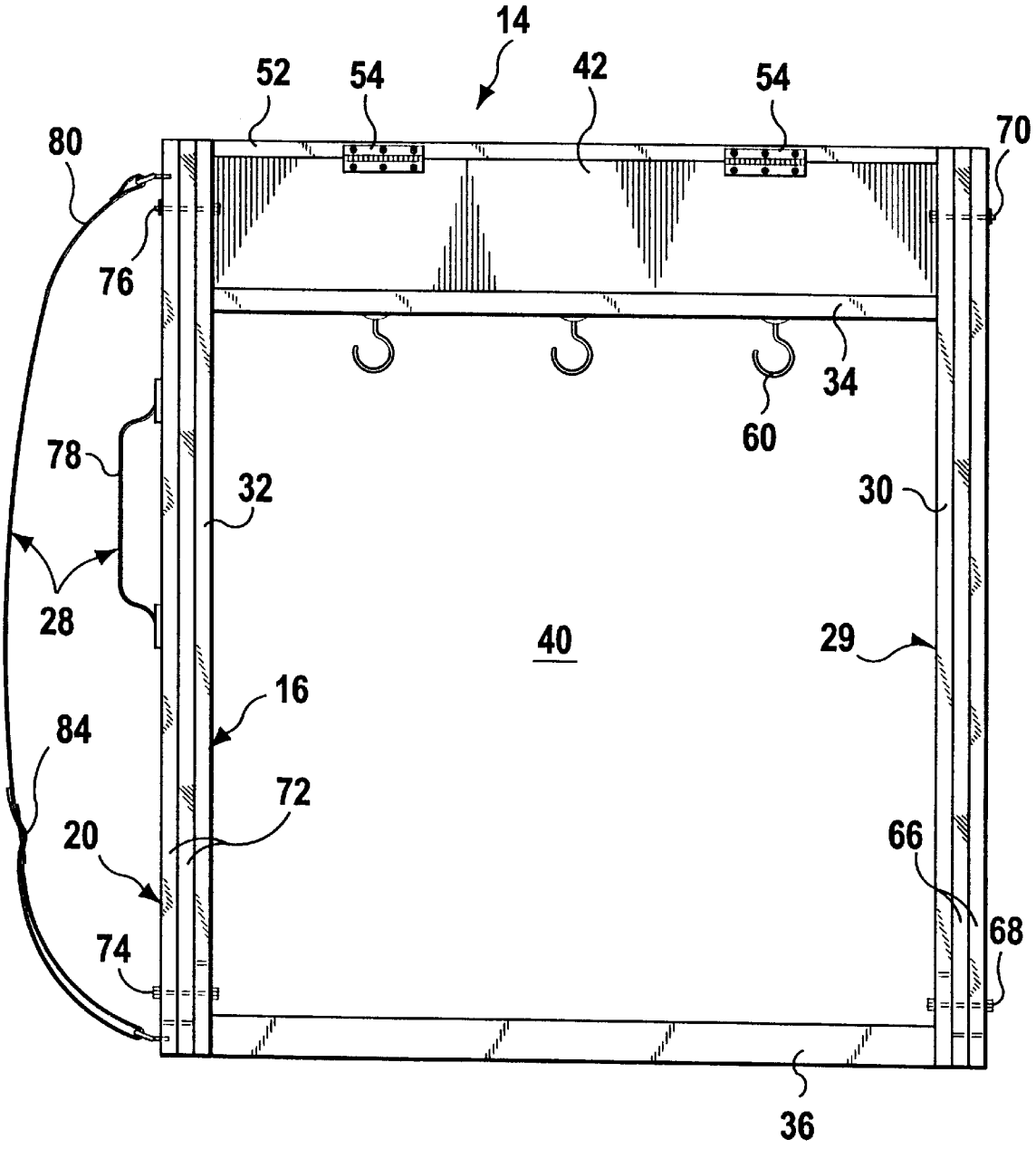
FIG. 2 is a rear elevational view of FIG. 1.

Turning now descriptively to the drawings, in which similar reference characters denote similar elements throughout the several views, FIGS. 1 to 12 illustrate a multifunction portable target stand 14 of the present invention. With regard to the reference numerals used, the following numbering is used throughout the various drawing

14 multifunction portable target stand
16 holding assembly of 14 for 18
18 target
supporting structure of 14 on 16
22 ground
24 person
26 shooting weapon
28 transporting facility of 14 on 20
29 frame for 16
30 first side member of 29
32 second side member of 29
34 top target rear stop crossbar of 29
35 bottom cross frame member of 29
36 bottom target rear stop crossbar of 29
38 styrofoam archery target for 18
40 target area in 29
41 movable mount in 29
42 target compartment of 16
44 longitudinal front slit in 42
46 roll of perforated paper targets for 18
48 vertical groove in 30 and 32
50 rod for 46
52 lid of 42
54 rear hinge between 42 and 52
56 front latch mechanism between 42 and 52
58 other item
60 J-hook of 16
62 other target for 18
64 lantern
66 first pair of legs of 20
68 first stationary pivot bolt of 20
70 first lock bolt of 20
72 second pair of legs of 20
74 second stationary pivot bolt of 20
76 second lock bolt of 20
78 handle for 28
80 shoulder strap for 28
82 shoulder of 24
84 adjustment clip on 80

The multifunction portable target stand 14 comprises an assembly 16 for holding a target 18. A structure 20 is pivotally connected to the holding assembly 16, for supporting the holding assembly 16 in an upright position above the ground 22 when the supporting structure 20 is in an extended position, so that a person 24 with a shooting weapon 26 at a remote location on the ground 22 can shoot at the target 18. A facility 28 on the supporting structure 20 is for transporting the multifunction portable target stand 14 to another location, when the supporting structure 20 is in a folded up position.

Figure 3:
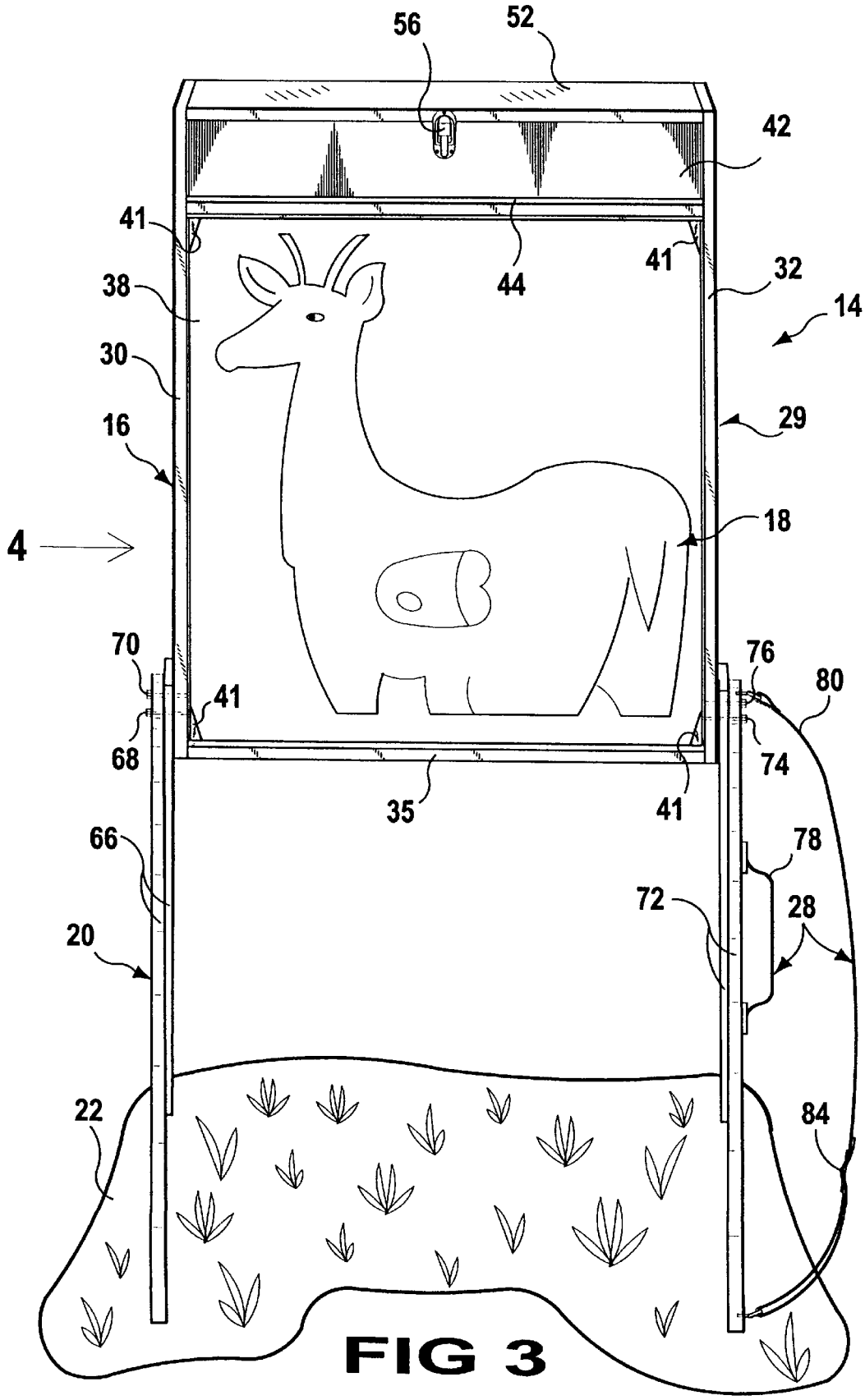
FIG. 3 is a front perspective view of the instant invention in an extended position with a pair of archery targets installed.
Figure 4:
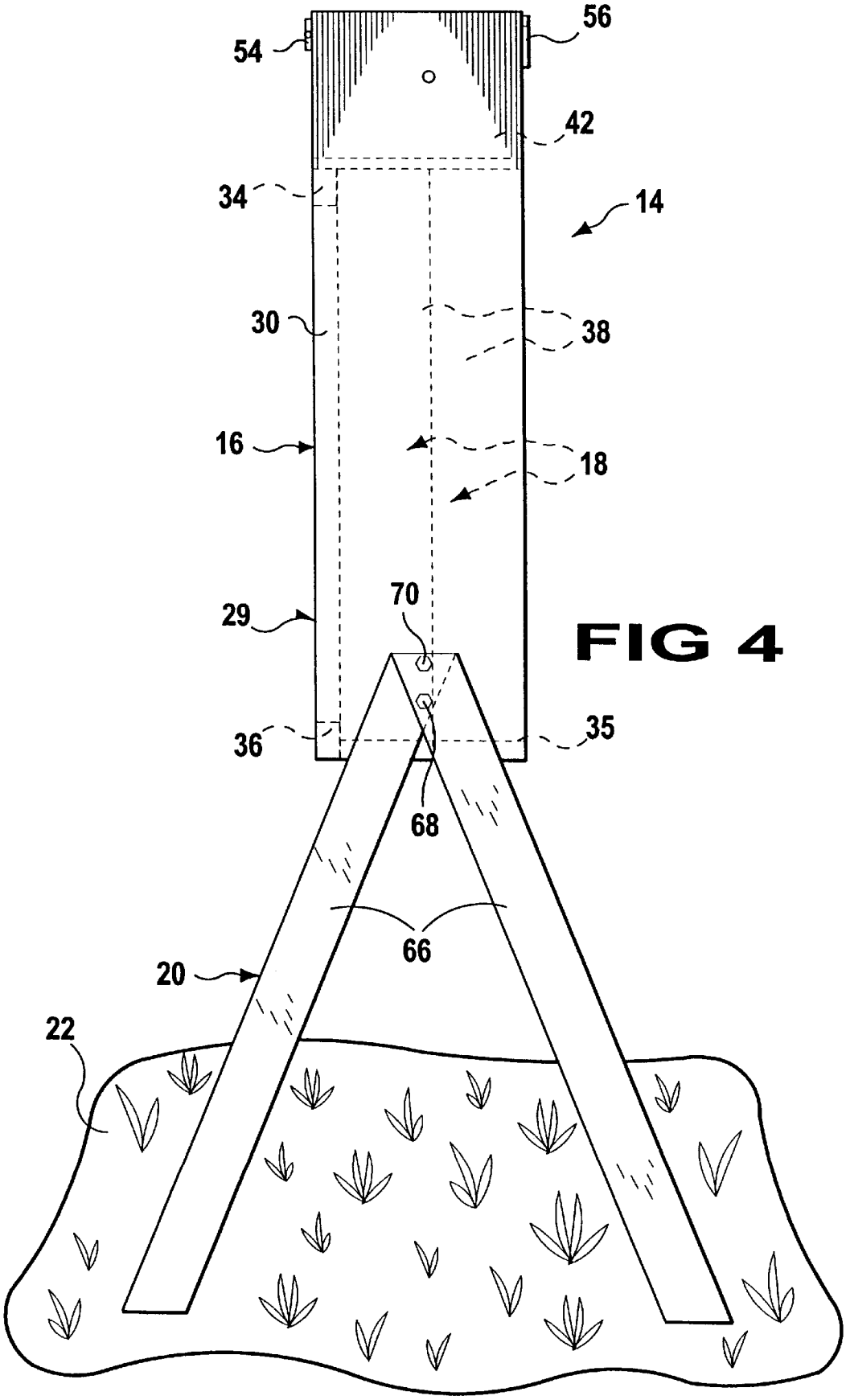
FIG. 4 is a side elevational view taken in the direction of arrow 4 in FIG. 3.
Figure 5:
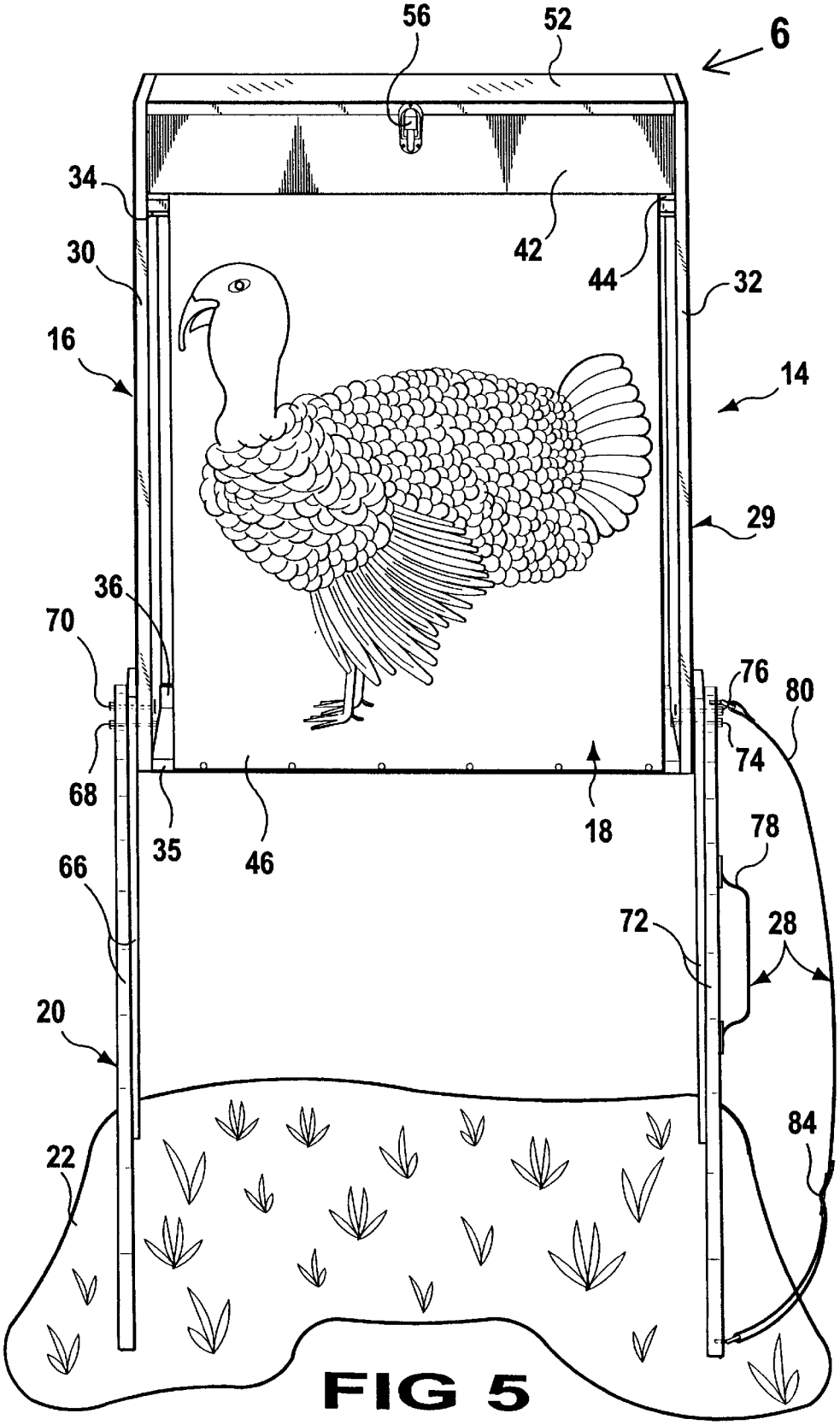
FIG. 5 is a front perspective view similar to FIG. 3, with a roll of perforated paper targets installed.
Figure 6:
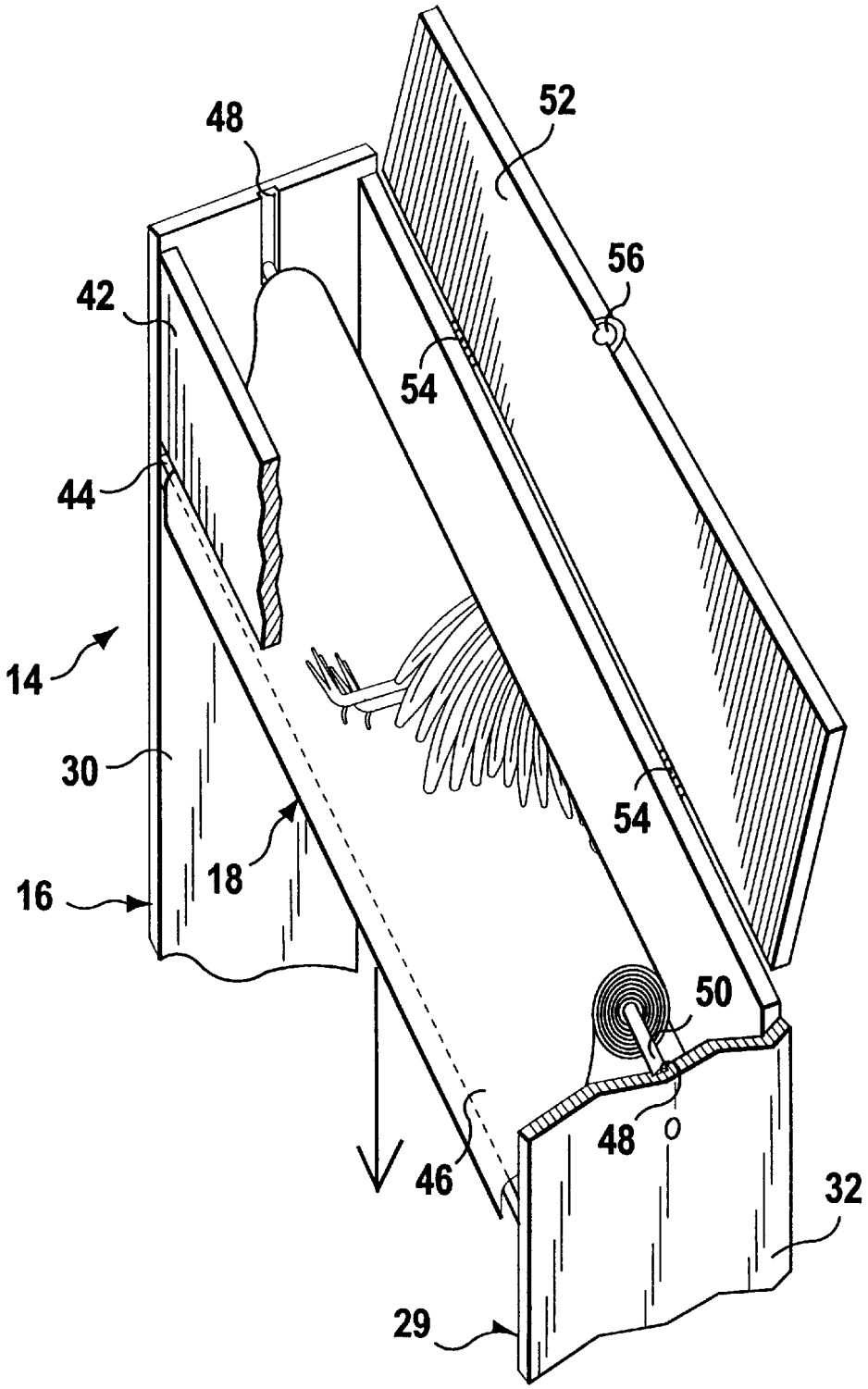
FIG. 6 is a top perspective view taken in the direction of arrow 6 in FIG. 5, with the lid of the storage compartment opened and parts broken away and in section.
Figure 12:
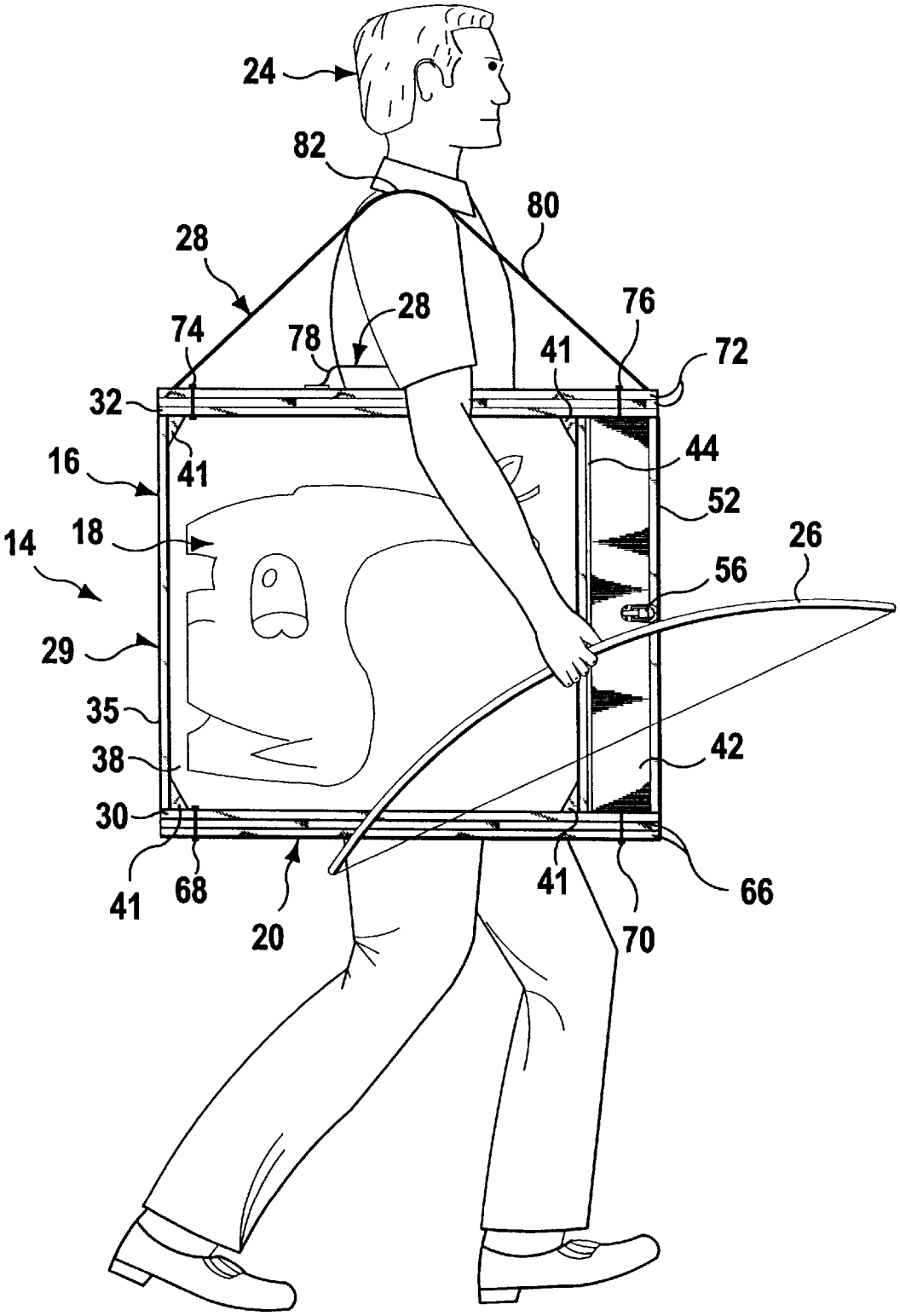
FIG. 12 is a front elevational view of the instant invention in the folded position being carried by the adjustable shoulder strap on a shoulder of a person.

The holding assembly 16 is a frame 29 that includes a pair of spaced apart parallel side members 30 and 32. A top target rear stop crossbar 34 is connected to and extends between the side members 30 and 32. A bottom cross frame member 35 is connected to and extends between the side members 30 and 32. A bottom target rear stop crossbar 36 is connected to and extends between the side members 30 and 32 directly behind the bottom cross frame member 35, so that the target 18 being a pair of styrofoam archery targets 38 can be installed within a target area 40 formed thereby. Four movable mounts 41, as shown in FIGS. 3 and 12, are also provided. Each movable mount 41 is pivotally connected at each front corner of the frame 29, to hold the styrofoam archery targets 38 in place within the target area 40.

The holding assembly 16 further includes a target compartment 42 attached to a top surface of the top target rear stop crossbar 34 and between upper ends of the side members 30 and 32. The target compartment 42 has an open top and a longitudinal front slot 44 therealong, so that the target 18 being a paper target on a roll of perforated paper targets 46 placed within the target compartment 42 can extend through the longitudinal front slot 44 and be fastened along its bottom edge to a front edge of the bottom cross frame member 35.

Figure 11:
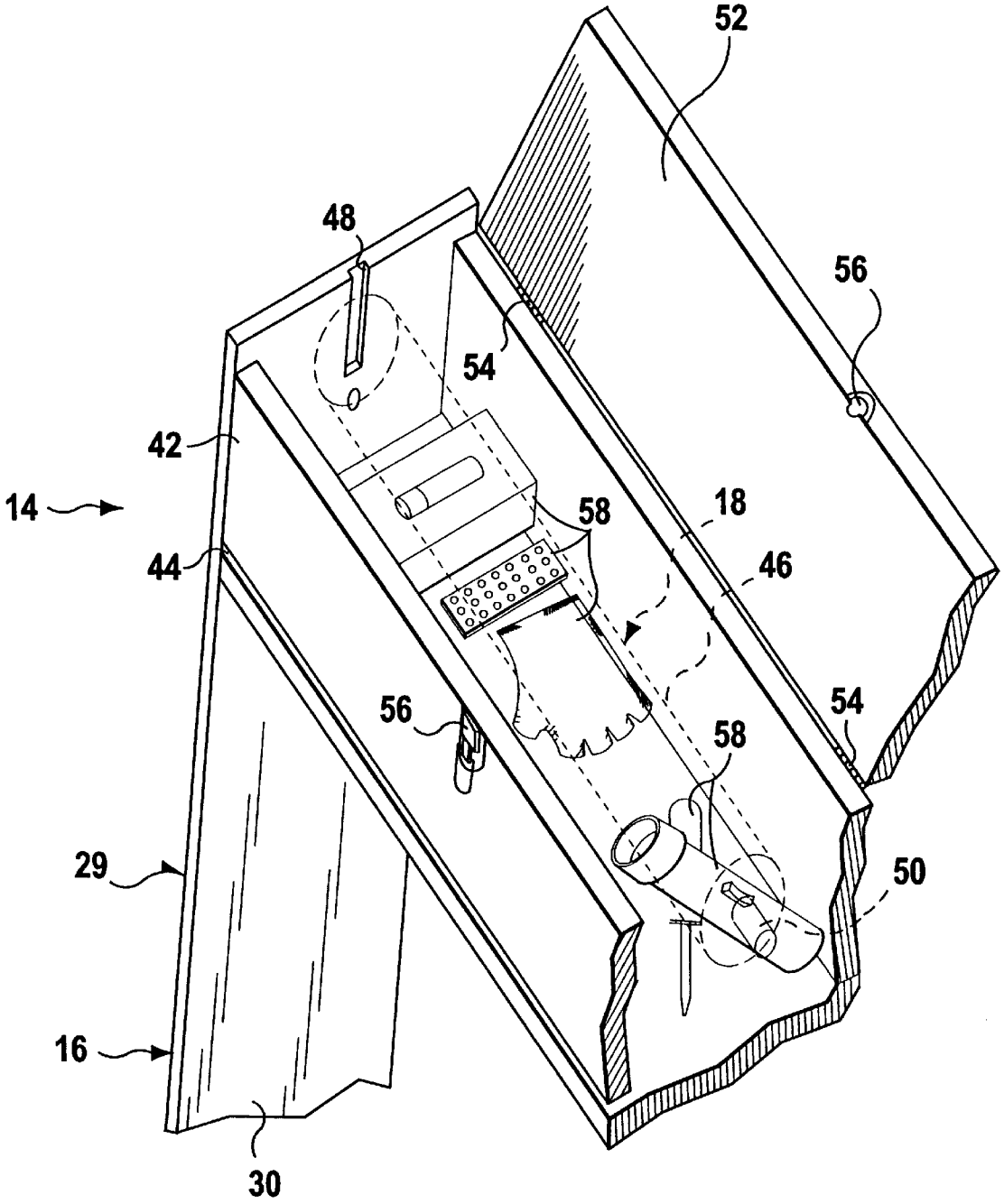
FIG. 11 is a top perspective view similar to FIG. 6, showing various articles within the storage compartment.

The target compartment 42 consists of each of the side members 30 and 32 at an upper end having an inwardly facing aligned vertical groove 48 therein, so that a rod 50 holding the roll of perforated paper targets 46 can rest within the vertical grooves 48. The target compartment 42 further contains a lid 52 to cover the open top. A pair of rear hinges 54 are between the lid 52 and the target compartment 42. A front latch mechanism 56 is between the lid 52 and the target compartment 42. When the roll of perforated paper targets 46 is removed therefrom, a plurality of other items 58, as shown in FIG. 11, can be stored within the target compartment 42.

Figure 7:
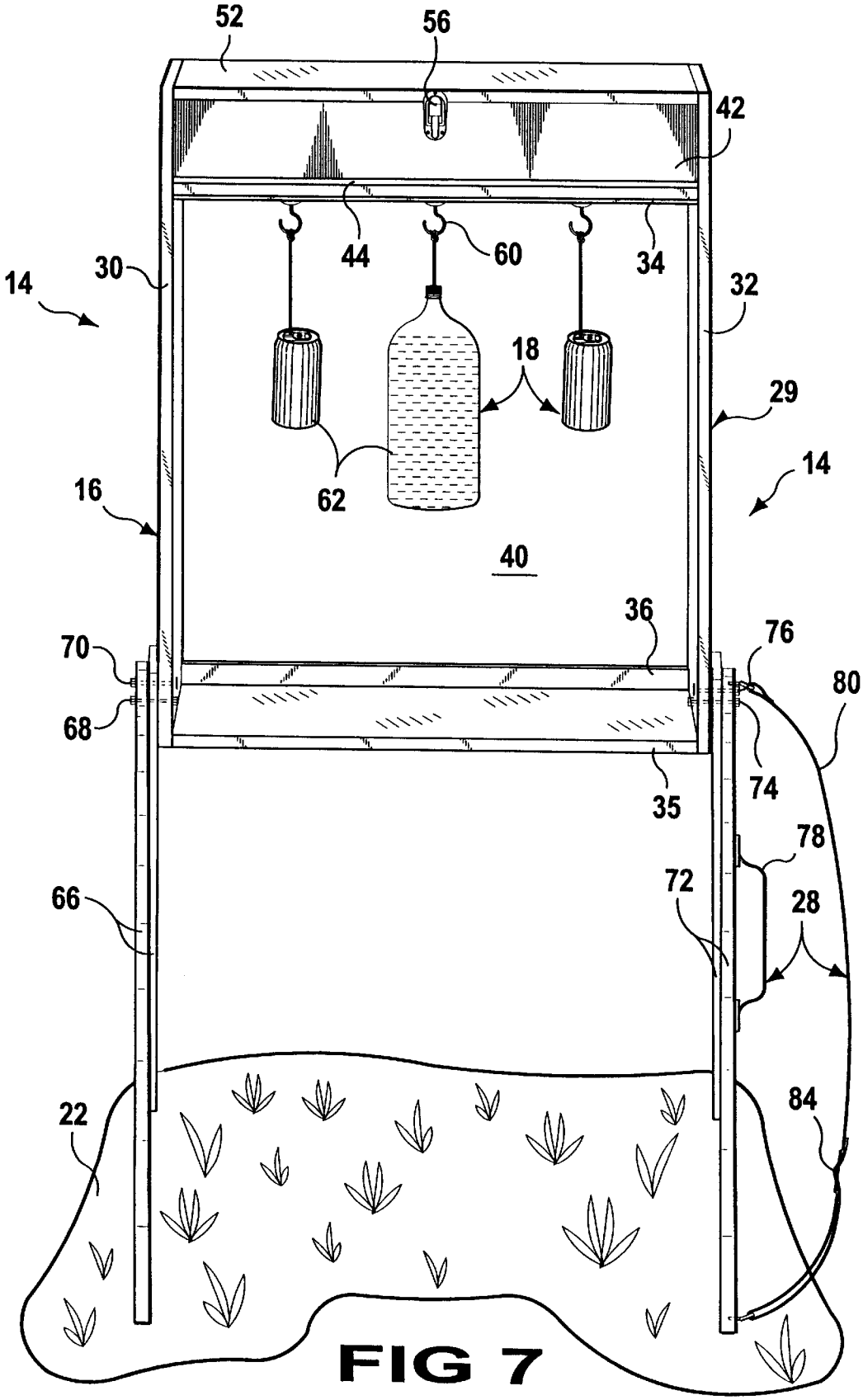
FIG. 7 is a front perspective view similar to FIG. 3, with a soda bottle and beverage cans suspended from the J-hooks to be used as other types of targets.
Figure 8:
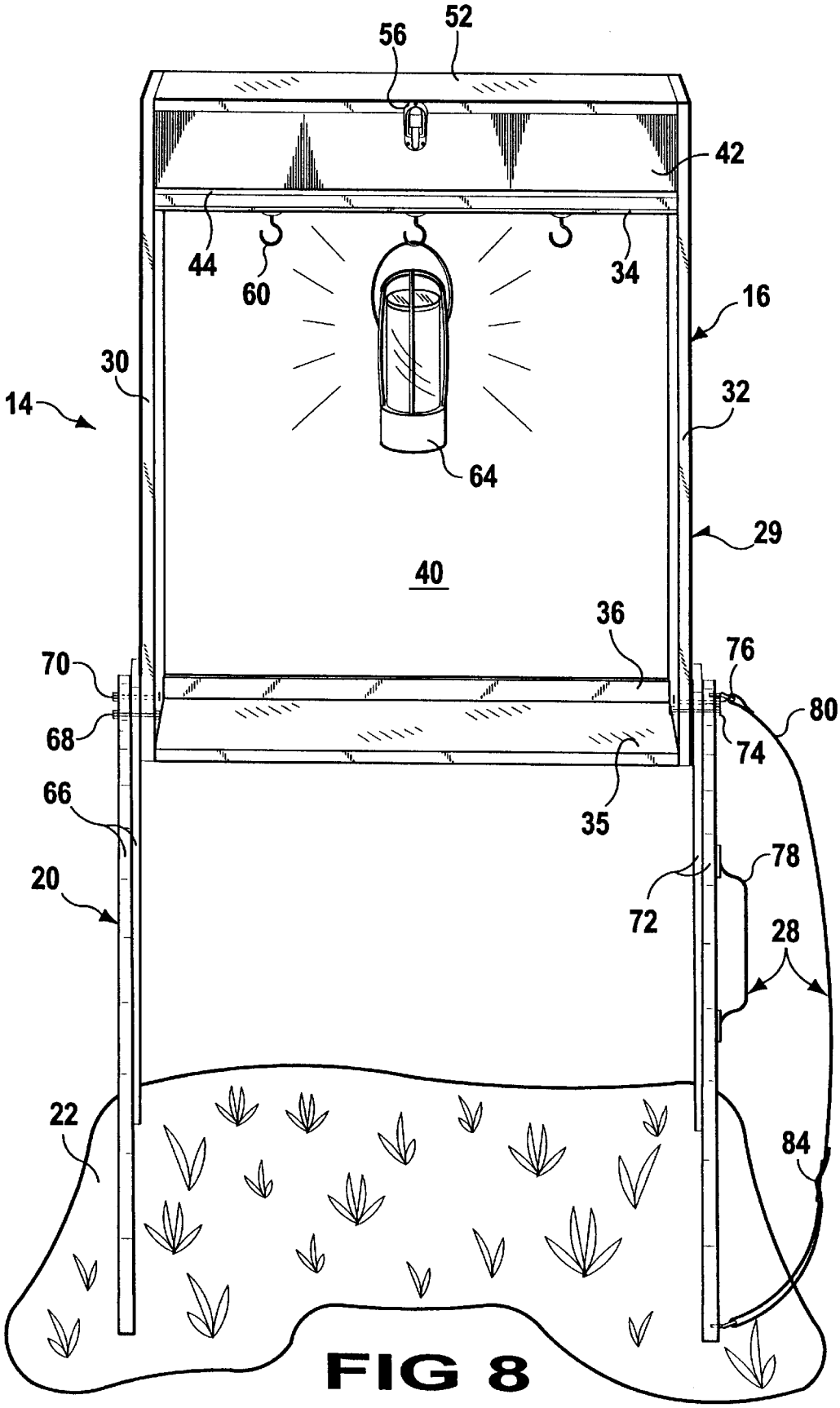
FIG. 8 is a front perspective view similar to FIG. 7, showing a lantern suspended from one of the J-hooks.
Figure 9:
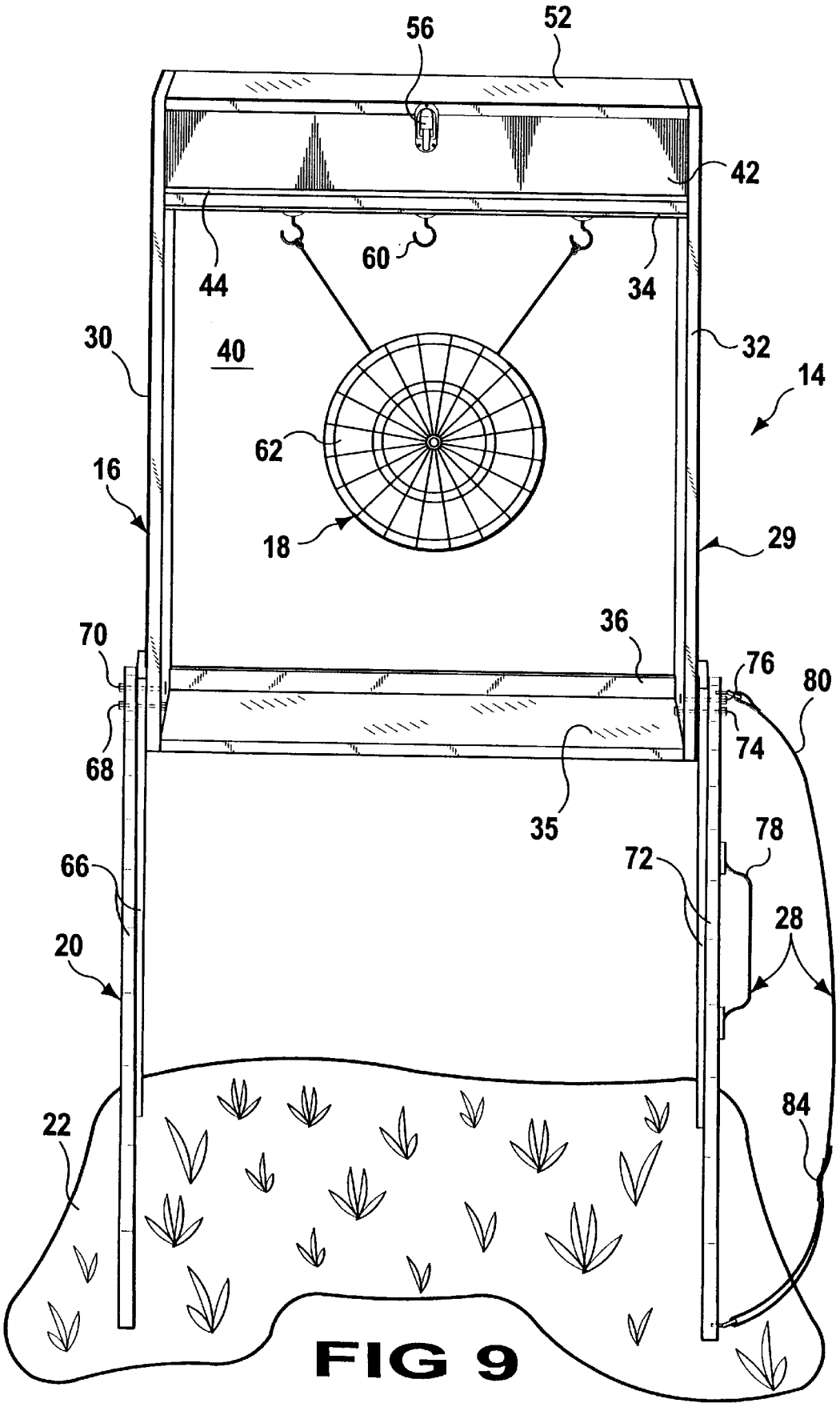
FIG. 9 is a front perspective view similar to FIG. 7, showing a dart board suspended from two of the J-hooks.
Figure 10:
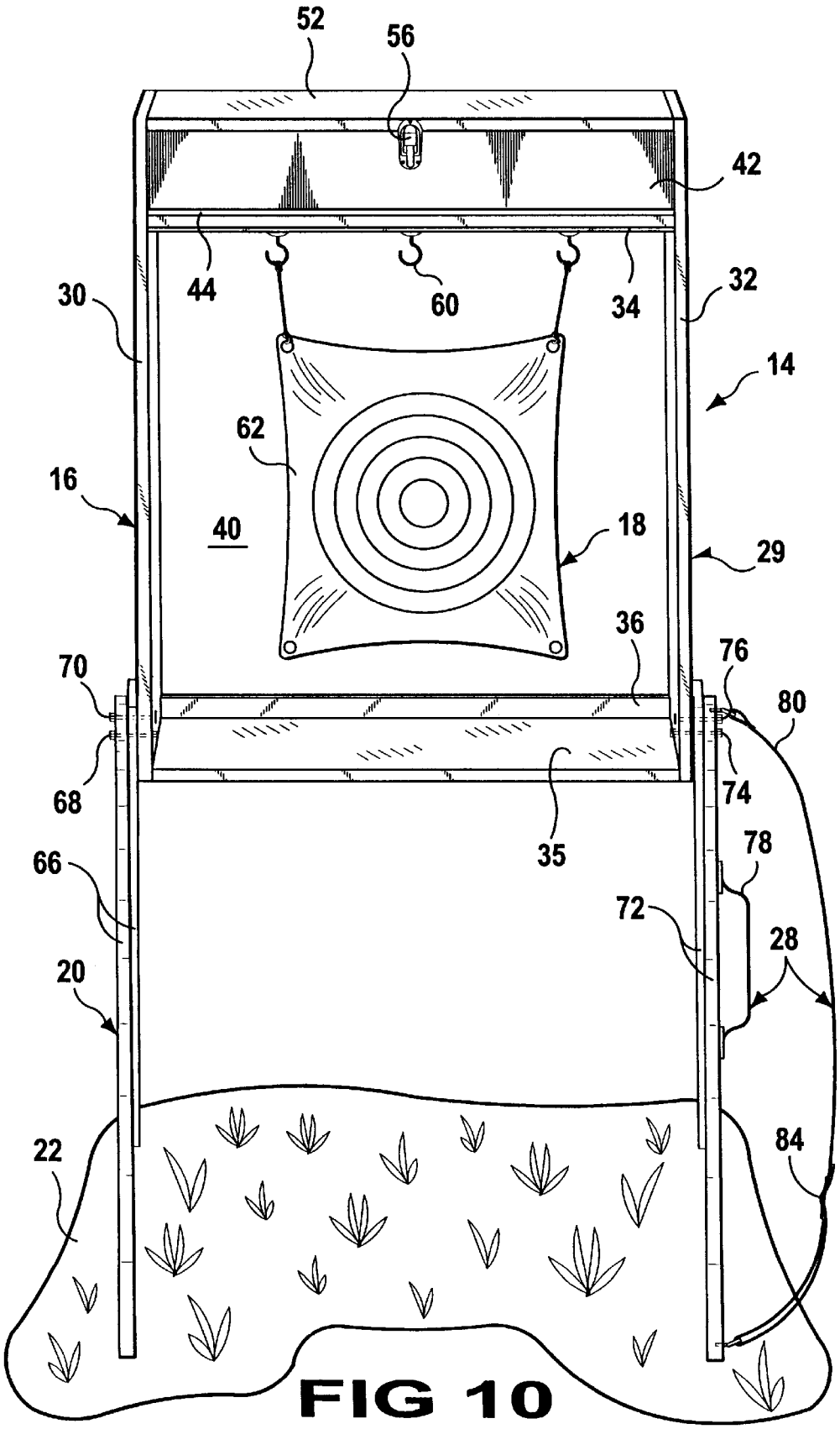
FIG. 10 is a front perspective view similar to FIG. 7, showing another type of archery target suspended from two of the J-hooks.

The holding assembly 16 further includes a plurality of J-hooks 60 spaced apart and attached to a bottom surface of the top target stop crossbar 34, so that the target 18 being a variety of different types of targets 62, such as a soda bottle and beverage cans in FIG. 7, a dart board in FIG. 9, and another type of archery target in FIG. 10, and a lantern 64, shown in FIG. 8, can be suspended from the J-hooks 60.

The supporting structure 20 consists of a first pair of legs 66. A first stationary pivot bolt 68 is for pivotally connecting upper ends of the first pair of legs 66 to a lower end of the first side member 30. A first lock bolt 70 is for connecting lower ends of the first pair of legs 66 to an upper end of the first side member 30, when the first pair of legs 66 are in a folded up position, as in FIGS. 1, 2 and 12, and for connecting upper ends of the first pair of legs 66 to the lower end of the first side member 30, when the first pair of legs 66 are in an extended inverted V-position, as in FIGS. 3 to 5 and 7 through 10.

A second pair of legs 72 are also provided. A second stationary pivot bolt 74 is for pivotally connecting upper ends of the second pair of legs 72 to a lower end of the second side member 32. A second lock bolt 76 is for connecting lower ends of the second pair of legs 72 to an upper end of the second side member 30, when the second pair of legs 72 are in a folded up position, as in FIGS. 1, 2 and 12, and for connecting upper ends of the second pair of legs 72 to the lower end of the second side member 32, when the second pair of legs 72 are in an extended inverted V-position, as in FIGS. 3 to 5 and 7 through 10.

The transporting facility 28 is a handle 78 connected to one side of the outermost one of the second pair of legs 72. A person 24 can grasp the handle 78, when the first pair of legs 66 and the second pair of legs 78 are in the folded up position.

The transporting facility 28 is also a shoulder strap 80 affixed at opposite ends to one side of the outermost one of the second pair of legs 72. A person 24 can carry the multifunction portable target stand 14 via the shoulder strap 80 on a shoulder 82, when the first pair of legs 66 and the second pair of legs 78 are in the folded up position (see FIG. 12). The shoulder strap 80 includes an adjustment clip 84, so that the length of the shoulder strap 80 can be adjusted to fit comfortably on the shoulder 82 of the person 24.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A multifunction portable target stand comprising:

a) means for holding a target, wherein said holding means is a frame that includes a pair of spaced apart parallel side members, a top target rear stop crossbar connected to and extending between said side members, a bottom cross frame member connected to and extending between said side members, a bottom target rear stop crossbar connected to and extending between said side members directly behind said bottom cross frame member, so that the target being a pair of styrofoam archery targets can be installed within a target area formed thereby and four movable mounts, each said movable mount being pivotally connected at each front corner of said frame, to hold said styrofoam archery targets in place within said target area;

b) means pivotally connected to said holding means, for supporting said holding means in an upright position above the ground when said supporting means is in an extended position, so that a person with a shooting weapon at a remote location on the ground can shoot at the target; and c) means on said supporting means, for transporting said multifunction portable target stand to another location, when said supporting means is in a folded up position.

2. A multifunction portable target stand as recited in claim 1, wherein said holding means further includes a plurality of J-hooks spaced apart and attached to a bottom surface of said top target stop crossbar, so that the target being a variety of different types of targets and a lantern can be suspended from said J-hooks.

3. A multifunction portable target stand as recited in claim 1, wherein said supporting means includes:

a) a first pair of legs;

b) a first stationary pivot bolt for pivotally connecting upper ends of said first pair of legs to a lower end of said first side member;

c) a first lock bolt for connecting lower ends of said first pair of legs to an upper end of said first side member, when said first pair of legs are in a folded up position and for connecting upper ends of said first pair of legs to the lower end of said first side member, when said first pair of legs are in an extended inverted V-position;

d) a second pair of legs;

e) a second stationary pivot bolt for pivotally connecting upper ends of said second pair of legs to a lower end of said second side member; and f) a second lock bolt for connecting lower ends of said second pair of legs to an upper end of said second side member, when said second pair of legs are in a folded up position and for connecting upper ends of said second pair of legs to the lower end of said second side member, when said second pair of legs are in an extended inverted V-position.

4. A multifunction portable target stand as recited in claim 3, wherein said transporting means is a handle connected to one side of the outermost one of said second pair of legs, so that a person can grasp said handle, when said first pair of legs and said second pair of legs are in the folded up position.

5. A multifunction portable target stand as recited in claim 3, wherein said transporting means is a shoulder strap affixed at opposite ends to one side of the outermost one of said second pair of legs, so that a person can carry said multifunction portable target stand via said shoulder strap on a shoulder, when said first pair of legs and said second pair of legs are in the folded up position.

6. A multifunction portable target stand as recited in claim 5, wherein said shoulder strap includes an adjustment clip, so that the length of said shoulder strap can be adjusted to fit comfortably on the shoulder of the person.

7. A multifunction portable target stand as recited in claim 1, wherein said holding means further includes a target compartment attached to a top surface of said top target rear stop crossbar and between upper ends of said side members, said target compartment having an open top and a longitudinal front slot therealong, so that the target being a paper target on a roll of perforated paper targets placed within said target compartment can extend through said longitudinal front slot and be fastened along its bottom edge to a front edge of said bottom cross frame member.

8. A multifunction portable target stand as recited in claim 7, wherein said target compartment further includes:

a) a lid to cover said open top;

b) a pair of rear hinges between said lid and said target compartment; and c) a front latch mechanism between said lid and said target compartment, so that when said roll of perforated paper targets is removed therefrom, a plurality of other items can be stored within said target compartment.

9. A multifunction portable target stand as recited in claim 7, wherein said target compartment includes each of said side members at an upper end having an inwardly facing aligned vertical groove therein, so that a rod holding the roll of perforated paper targets can rest within said vertical grooves.

10. A multifunction portable target stand as recited in claim 9, wherein said target compartment further includes:

a) a lid to cover said open top;

b) a pair of rear hinges between said lid and said target compartment; and c) a front latch mechanism between said lid and said target compartment, so that when said roll of perforated paper targets is removed therefrom, a plurality of other items can be stored within said target compartment.

11. A multifunction portable target stand as recited in claim 10, wherein said holding means further includes a plurality of J-hooks spaced apart and attached to a bottom surface of said top target stop crossbar, so that the target being a variety of different types of targets and a lantern can be suspended from said J-hooks.

12. A multifunction portable target stand as recited in claim 11, wherein said supporting means includes:

a) a first pair of legs;

b) a first stationary pivot bolt for pivotally connecting upper ends of said first pair of legs to a lower end of said first side member;

c) a first lock bolt for connecting lower ends of said first pair of legs to an upper end of said first side member, when said first pair of legs are in a folded up position and for connecting upper ends of said first pair of legs to the lower end of said first side member, when said first pair of legs are in an extended inverted V-position;

d) a second pair of legs;

e) a second stationary pivot bolt for pivotally connecting upper ends of said second pair of legs to a lower end of said second side member; and f) a second lock bolt for connecting lower ends of said second pair of legs to an upper end of said second side member, when said second pair of legs are in a folded up position and for connecting upper ends of said second pair of legs to the lower end of said second side member, when said second pair of legs are in an extended inverted V-position.

13. A multifunction portable target stand as recited in claim 12, wherein said transporting means is a handle connected to one side of the outermost one of said second pair of legs, so that a person can grasp said handle, when said first pair of legs and said second pair of legs are in the folded up position.

14. A multifunction portable target stand as recited in claim 13, wherein said transporting means is a shoulder strap affixed at opposite ends to one side of the outermost one of said second pair of legs, so that a person can carry said multifunction portable target stand via said shoulder strap on a shoulder, when said first pair of legs and said second pair of legs are in the folded up position.

15. A multifunction portable target stand as recited in claim 14, wherein said shoulder strap includes an adjustment clip, so that the length of said shoulder strap can be adjusted to fit comfortably on the shoulder of the person.

* * * * *